US006617770B2

(12) United States Patent
Machida

(10) Patent No.: US 6,617,770 B2
(45) Date of Patent: Sep. 9, 2003

(54) GAS FILLED SWITCHING ELECTRIC DISCHARGE TUBE

(75) Inventor: Kazuhiko Machida, Nagano (JP)

(73) Assignee: Shinko Electric Industries Co., LTD, Nagano (JP)

( * ) Notice: Subject to any disclaimer, the term of this patent is extended or adjusted under 35 U.S.C. 154(b) by 0 days.

(21) Appl. No.: 10/083,202

(22) Filed: Feb. 26, 2002

(65) Prior Publication Data

US 2003/0034730 A1 Feb. 20, 2003

(30) Foreign Application Priority Data

Mar. 9, 2001 (JP) ..... 2001-067414

(51) Int. Cl.[7] ..... H01J 17/26
(52) U.S. Cl. ..... 313/231.01; 313/231.31
(58) Field of Search ..... 313/231.01, 231.11, 313/231.31, 231.41, 155, 161

(56) References Cited

FOREIGN PATENT DOCUMENTS

JP 63-24576 2/1988
JP 3-77292 A 4/1991
JP 3-77293 A 4/1991

*Primary Examiner*—Vip Patel
(74) *Attorney, Agent, or Firm*—Paul & Paul

(57) ABSTRACT

To extend the life of electric discharge and enhance the characteristic of electric discharge in the life test in a gas filled switching electric discharge tube. A gas filled switching electric discharge tube comprises: a cylindrical body (1) made of insulating material; two electrodes (2, 3) for airtightly closing both ends of the cylindrical body; an electric discharge gap, an airtightly closed space formed in the cylindrical body including the electric discharge gap being filled with gas; metallized faces formed on both end faces of the electrodes of the cylindrical body; first trigger wires (10*a*, 10*b*) formed on an inner wall face of the cylindrical body, connected with the metallized faces; and second trigger wires (10*c*) formed on the inner wall face of the cylindrical body, not connected with the metallized faces, wherein the first electrode face and second electrode face are plated with copper or silver.

17 Claims, 6 Drawing Sheets

GAS FILLED SWITCHING ELECTRIC DISCHARGE TUBE

BACKGROUND OF THE INVENTION

1. Field of the Invention

The present invention relates to a gas filled switching electric discharge tube. More particularly, the present invention relates to the structure of a gas filled switching electric discharge tube in which the voltage characteristic at the time of electric discharge is improved.

2. Related Art

The gas filled switching electric discharge tube includes: a cylindrical body made of insulating material such as ceramic; and a first electrode and a second electrode for airtightly closing both ends of the cylindrical body, wherein an electric discharge gap is formed between the first electrode face of the first electrode and the second electrode face of the second electrode, and gas is filed into an airtightly closed space which is formed in the cylindrical body including the electric discharge gap. Due to the above structure, electric discharge is generated between the first electrode face and the second electrode face.

In the case where switching is conducted in the thus composed conventional switching electric discharge tube after it has been left in a completely dark place, the electric discharge voltage (FVs) of the first time is necessarily higher than the electric discharge voltage (Vs) of the second time and the times after that. The reason why is that, as the switching electric discharge tube has been left in a dark place, it is impossible for photo-electrons, which always excite the filled gas in a bright state, to provide an excitation effect (the photo-electron effect).

Conventionally, the life of electric discharge of the electric discharge tube has been extended and the increase of the FVs characteristic, in a life test, has been prevented by arranging carbon trigger wires on an inner wall face of the cylindrical body made of ceramic and devising various methods of arrangement.

For example, in order to improve the voltage characteristic of this type of switching electric discharge tube in the case of discharging, the following arrangements have been proposed. Metallized faces are formed on both end faces, which come into contact with the electrodes, of the cylindrical body made of ceramic, and trigger wires are provided which come into contact with the metallized faces and extend on an inner wall face of the cylindrical body, or alternatively trigger wires are provided which do not come into contact with the metallized faces but extend on the inner wall face of the cylindrical body.

In the conventional switching electric discharge tube of this type, as the electrode and the cylindrical body made of ceramic are joined to each other by means of soldering, the electrode is made of a low thermal expansion alloy, the coefficient of thermal expansion of which is close to that of a ceramic, such as covar or iron-nickel alloy. However, as the electric conductivity of the above material is low, generation of the creeping corona discharge in a dark place is delayed, which raises the switching electric discharge starting voltage FVs of the first electric discharge to higher than that of the second electric discharge.

In order to solve the above problems, the following countermeasures have been taken conventionally. According to Japanese Unexamined Patent Publication No. 63-24576, the electrode itself is made of copper, and hydrogen gas is partially filled into the electric discharge tube. According to Japanese Unexamined Patent Publication Nos. 3-77292 and 3-77293, the electrode made of covar or iron-nickel alloy is plated with copper or a copper alloy.

However, in the conventional gas filled switching electric discharge tube described above, when only carbon trigger wires are formed in the cylindrical body or when only an arrangement of the carbon trigger wires is devised or when only the electrode itself is made of copper or only when the electrode made of covar or iron-nickel alloy is plated with copper or copper alloy, it is difficult for the extension of the life of electric discharge to be compatible with the prevention of a rise in the FVs characteristic in the case of a life test. In view of the above problems caused in the prior art, the present invention has been accomplished.

SUMMARY OF THE INVENTION

Accordingly, an object of the present invention is to provide a gas filled switching electric discharge tube, the characteristic of which will be described as follows. The low electric conductivity, which is a property of the material composing the electrode itself, is improved by conducting plating on the electrode. Further, when an interval of the electric discharge gap and an interval between the electrode face and the trigger wires are regulated, the extension of the life of electric discharge and the prevention of a rise in the FVs characteristic in the case of a life test can be accomplished.

According to the present invention, there is provided a gas filled switching electric discharge tube comprising: a cylindrical body made of insulating material; a first and a second electrode for airtightly closing both ends of the cylindrical body so that an electric discharge gap is formed between a first electrode face of the first electrode and a second electrode face of the second electrode, and an airtightly closed space formed in the cylindrical body being filled with gas; metallized faces formed on both faces of the cylindrical body, the first and the second electrode being joined to the cylindrical body on both the end faces of the cylindrical body; first trigger wires formed on an inner wall face of the cylindrical body, connected with the metallized faces; second trigger wires formed on the inner wall face of the cylindrical body, not connected with the metallized faces; at least one of the first electrode face of the first electrode and the second electrode face of the second electrode is plated with copper or silver; and an interval of the electric discharge gap being made to be larger than a distance from the second trigger wires to the first or the second electrode face.

The cylindrical body is a cylinder, the first and the second electrode face are substantially circular and formed around the central axis of the cylindrical body, the first and the second electrode face are arranged being symmetrically opposed to each other, the first trigger wires extend from the metallized faces in the axial direction on the inner wall face of the cylindrical body, however, the first trigger wires do not reach a central portion of the cylindrical body, the second trigger wires extend in the central portion of the cylindrical body in the axial direction, and a distance (d) from the second trigger wires to the first or second electrode face is a radial distance from an outer surface of these electrodes to an inner wall of the cylindrical body.

The electric discharge gap (t) is a distance between tips of the first electrode face and the second electrode face facing to each other.

At least one of the first electrode face of the first electrode and the second electrode face of the second electrode is plated with copper or silver so that a thickness of the plated layer is 10–20 μm.

The number of the second trigger wires is larger than the number of the second trigger wires.

The first trigger wires extend from the metallized face in the axial direction along an inner wall face of the cylindrical body, however, they do not extend over a central area, and, on the other hand, the second trigger wires extend in the axial direction at the central area.

The first trigger wires include a pair thereof spaced by 180°, one extending in the axial direction from one of the metallized faces and the other extending in the axial direction from the other of the metallized faces.

The pair of the first trigger wires are respectively composed of a plurality of trigger lines arranged close and parallel to each other.

The length of the first trigger wire in the axial direction is not more than ⅓ of the length of the cylindrical body in the axial direction.

A plurality of the second trigger wires are arranged at substantially regular intervals between a pair of the first trigger wires which are arranged at an interval of 180°.

The length of the second trigger wire in the axial direction is not less than ½ of the length of the cylindrical body in the axial direction.

A plurality of recessed portions are provided on at least one of the first and the second electrode faces.

The recess portions are hemispherical recess portions.

The plurality of recess portions are uniformly arranged at regular pitches of 0.1–1.0 mm.

The first and the second electrode faces are arranged to be symmetrically opposed to each other, central portions of the electrode faces are hollowed with respect to the peripheral portion, and the plurality of recess portions are formed in the hollow portion.

The cylindrical body is made of ceramic, and the first and the second electrode are made of iron-nickel alloy such as 42 alloy or iron-nickel-cobalt alloy such as covar.

The first and the second electrode are joined to the cylindrical body by means of soldering.

BRIEF DESCRIPTION OF THE DRAWINGS

FIG. 2(*b*) is a developed view of an inner wall of a gas filled switching electric discharge tube of an embodiment of the present invention, wherein an exemplary arrangement of trigger wires is shown;

FIG. 3(*b*) is a plan view of the electrode which is taken from the electrode face side;

FIG. 4(*b*) is a plan view of the electrode which is taken from the electrode face side;

DETAILED DESCRIPTION OF THE PREFERRED EMBODIMENTS

Referring to the appended drawings, an embodiment of the present invention will be explained below.

Figure 1:
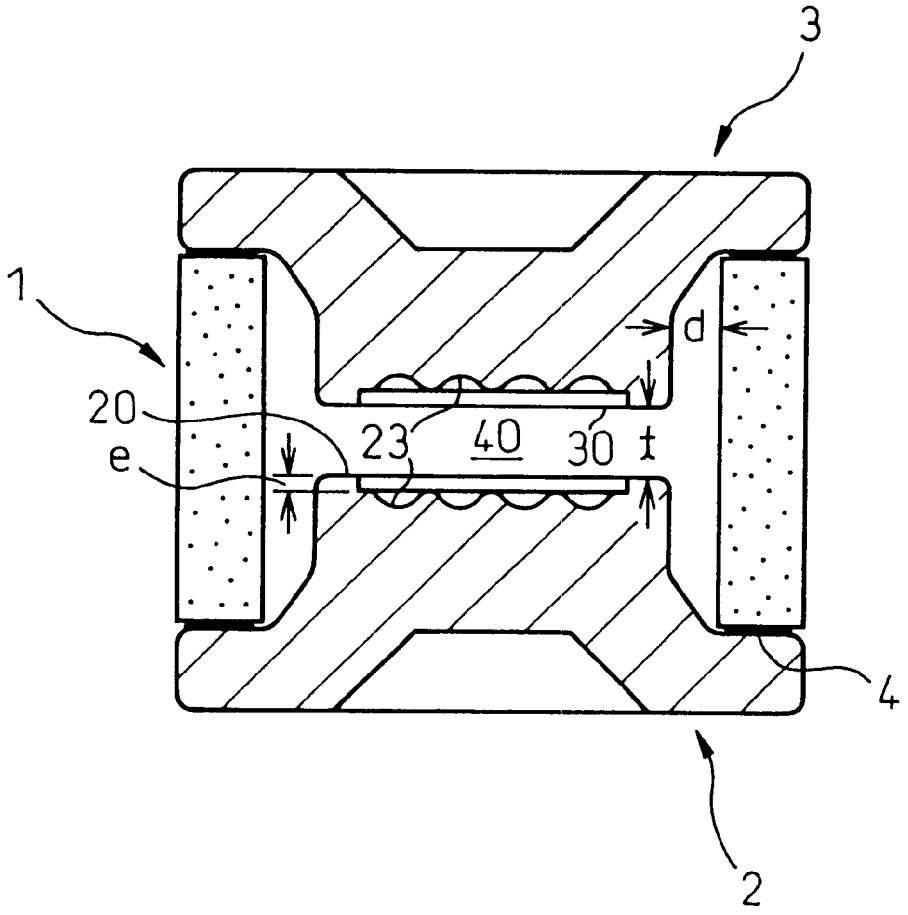
FIG. 1 is a sectional view of a gas filled switching electric discharge tube of an embodiment of the present invention.
Figure 2A:
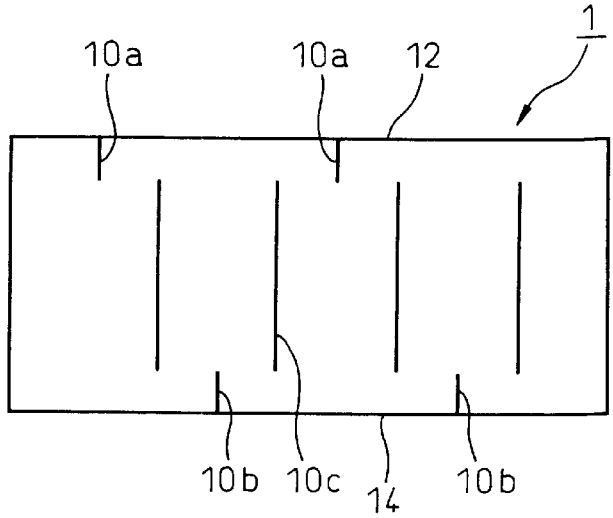
FIG. 2(*a*) is a developed view of an inner wall of a gas filled switching electric discharge tube of an embodiment of the present invention, wherein an exemplary arrangement of trigger wires is shown.
Figure 2B:
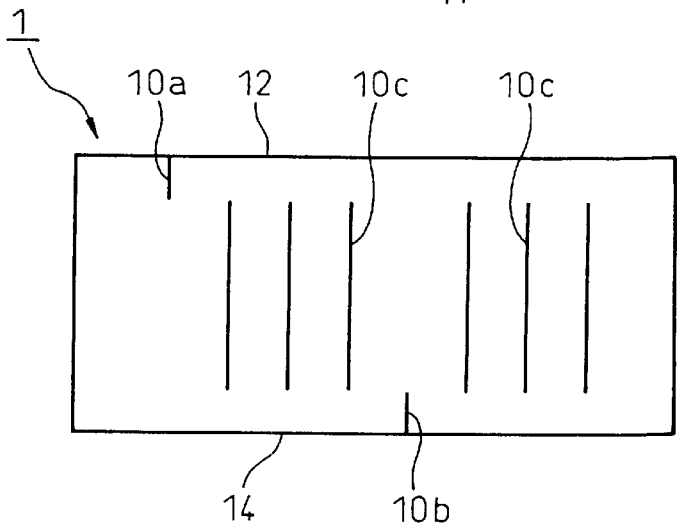

FIG. 1 is a sectional view of a gas filled switching electric discharge tube of an embodiment of the present invention, and FIGS. 2(*a*) and 2(*b*) are developed views of a cylindrical body made of ceramic used for the electric discharge tube of the present invention.

The gas filled switching electric discharge tube of the present invention includes: a cylindrical body 1 made of insulating material such as ceramic; and a first electrode 2 and a second electrode 3 for airtightly closing both end portions of the cylindrical body 1. The cylindrical body 1 is joined to the first electrode 2 and the second electrode 3 by the solder 4.

Both end faces of the cylindrical body 1 made of ceramic are formed into the metallized faces 12, 14. As can be seen in the embodiment shown in FIG. 2(*a*), the carbon trigger wires 10*a*, 10*b* on the sides of the metallized faces 12, 14 are arranged at an interval of 90° and alternately extended from the metallized faces 12, 14 on the inner wall face of the cylindrical body 10 made of ceramic in the axial direction, that is, four carbon trigger wires are alternately extended on the inner wall face of the cylindrical body 10 in the axial direction. Lengths in the axial direction of the carbon trigger wires 10*a*, 10*b* on the sides of the metallized faces 12, 14 are relatively small and approximately not more than ¼ of the length of the cylindrical body 1, made of ceramic, in the axial direction.

On the other hand, the carbon trigger wires 10*c* extend in the axial direction in the central portion on the inner wall face of the cylindrical body 1 made of ceramic. In this structure, one carbon trigger wire 10*c* is arranged at the intermediate position between the carbon trigger wires 10*a*, 10*b* on the sides of the metallized faces 12, 14, that is, four carbon trigger wires are arranged in total. The trigger wires 10*a*, 10*b*, 10*c* are arranged at regular intervals of about 45° in the circumferential direction. These trigger wires 10*c* arranged at the center do not come into contact with the metallized faces 12, 14. These trigger wires 10*c* arranged at the center are relatively longer than the carbon trigger wires 10*a*, 10*b* arranged on the sides of the metallized faces 12, 14. Lengths of these trigger wires 10*c* are approximately not less than ½ of the length of the cylindrical body 1 made of ceramic in the axial direction.

In the embodiment shown in FIG. 2(*b*), concerning the carbon trigger wires 10*a*, 10*b* on the sides of the metallized faces 12, 14, one carbon trigger wire 10*a* and one carbon trigger wire 10*b* are arranged at an interval of 180°. On the other hand, concerning the carbon trigger wires 10*c* in the central portion, three carbon trigger wires 10*c* are arranged every between the carbon trigger wires 10*a*, 10*b* on side of the metallized faces 12, 14 at regular intervals (about 45°), that is, six carbon trigger wires 10*c* are arranged in total.

Since the electrodes 2, 3 are joined to the cylindrical body 10 made of ceramic by the solder 4, the electrodes 2, 3 are made of low thermal expansion material of iron-nickel alloy such as 42 alloy or a iron-nickel-cobalt alloy such as covar. Profiles of these electrodes 2, 3 are the same, and the electrode faces 20, 30 are formed to be substantially circular around the central axis of the cylindrical body 1 made of ceramic. These electrode faces 20, 30 are arranged being symmetrically opposed to each other. Between these electrode faces 20, 30, the electric discharge gap 40 is formed. As widely known, the inside of the cylindrical body 1 including the electric discharge gap 40 is filled with inert gas such as argon gas. When a predetermined voltage is impressed between the electrodes 2, 3, electric discharge occurs between the electrode faces 20, 30.

Figure 3B:
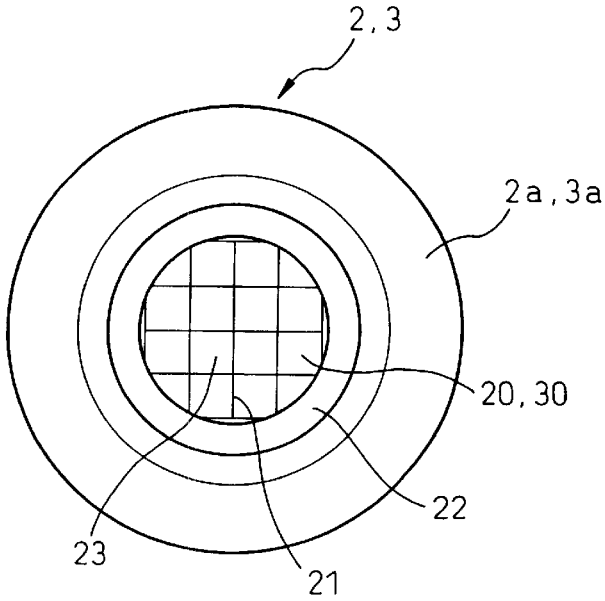
FIG. 3(*a*) is a sectional view of an electrode used for an electric discharge tube of an embodiment of the present invention.
Figure 3A:
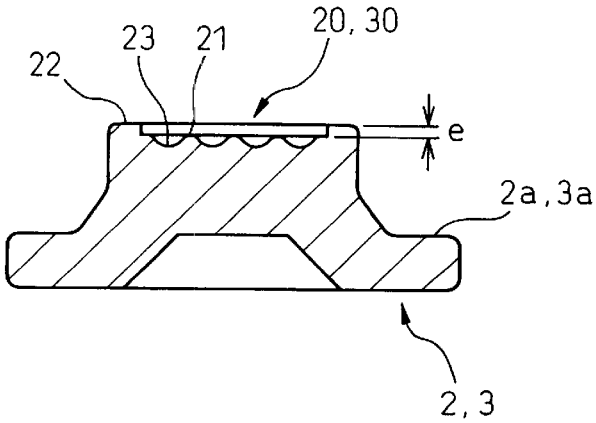

FIG. 3(*a*) is a sectional view showing an electrode used for a gas filled switching electric discharge tube of an embodiment of the present invention shown in FIG. 1, and FIG. 3(*b*) is a plan view of the electrode, wherein the view is taken from the electrode face side.

A pair of electrodes 2, 3 are the same in the size and profile. Each electrode 2, 3 is integrally formed into one body, and the pair of electrodes 2, 3 are arranged symmetrically with each other. The peripheral portions of the electrodes 2, 3 are formed into the flat flange portions 2*a*, 3*a* which are joined to the end faces of the cylindrical body 1 by the solder 4. The inside central portions of the electrodes 2, 3, which are opposed to each other, are formed into the electrode faces 20, 30.

The substantially circular electrode faces 20, 30 have a relatively large area. The central portion 21 of each electrode face 20, 30, which occupies most of the area of the electrode, is uniformly hollowed by the depth e with respect to the peripheral portion 22 of the electrode. In this hollow portion 21, a plurality of hemispherical recess portions 23 are formed. The plurality of hemispherical recess portions 23 are uniformly arranged at regular pitches of 0.8 mm.

The electrode faces 20, 30 having the plurality of hemispherical recess portions 23 are coated with an electric discharge activating coating agent. When a quantity of the electric discharge activating coating agent to be coated is appropriately adjusted, it is possible to extend the life of electric discharge.

In FIG. 1, the interval t of the electric discharge gap 40, which is measured at the end portions of the electrode faces 20, 30, is larger than the distance d which is a distance from the carbon trigger wire 10*c* at the central portion to the electrode face 20, 30, that is, a distance in the radial direction from the outer circumference of the electrode face 20, 30 to the inner wall of the cylindrical body made of ceramic.

Figure 4B:
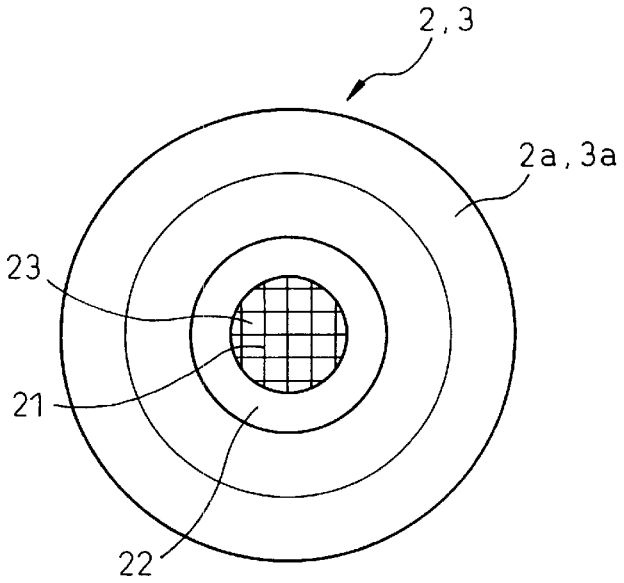
FIG. 4(*a*) is a sectional view of an electrode used for an electric discharge tube of a comparative example.
Figure 4A:
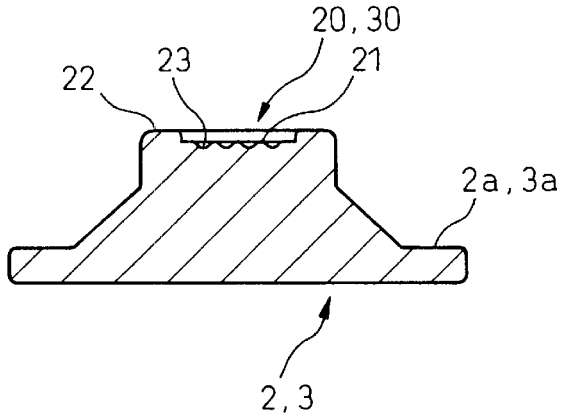
Figure 5:
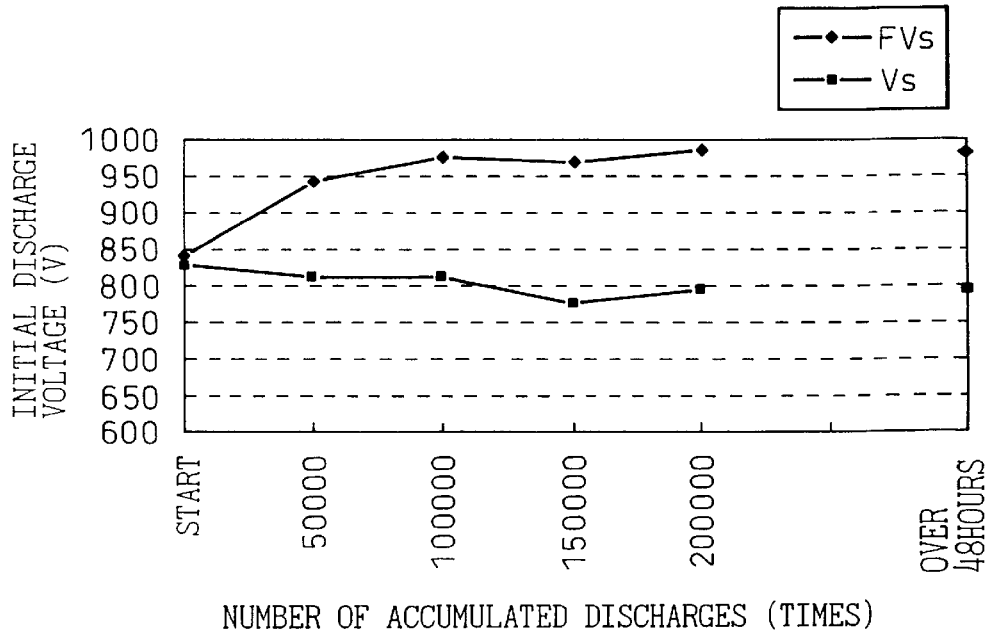
FIG. 5 is a graph showing the result of a dark place electric discharge life test which was made when the thickness of a copper plated layer was smaller than 10 μm.

FIG. 4(*a*) is a sectional view of a gas filled switching electrode used for an electric discharge tube of a comparative example, and FIG. 4(*b*) is a plan view of the electrode which is taken from the electrode face side. Different points of this comparative example from the embodiment of the present invention shown in FIGS. 3(*a*) and 3(*b*) are described as follows. Areas of the electrode faces 20, 30 of this comparative example are smaller than those of the embodiment of the present invention, and a pitch of the plurality of hemispherical recess portions 23 provided on the electrode face is smaller than that of the electrode of the aforementioned embodiment (The pitch is 0.4 mm.). Other points of the comparative example are the same as those of the electrode of the embodiment of the present invention.

When the electrode shown in this comparative example is adopted and the gas filled switching electric discharge tube shown in FIG. 1 is composed, that is, when the electrodes 2, 3 shown in FIG. 1 are replaced with the electrodes shown in FIGS. 4(*a*) and 4(*b*), the distance d in the radial direction from the outer circumference of the electrode face 20, 30 to the inner wall of the cylindrical body made of ceramic is relatively large. Therefore, it is difficult for the interval t of the electric discharge gap, which is measured at the end portions of the electrode faces 20, 30, to be made larger than the distance d.

As explained above, the characteristics of the gas filled switching electric discharge tube of the present invention are expressed by the following items (1) and (2).

(1) In the present invention, copper plating is conducted on the electric discharge electrode. Concerning the material of the electrode, as the electrode is soldered to a ceramic, covar or iron-nickel alloy, the linear thermal expansion coefficient of which is similar to that of a ceramic, is adopted as described before. However, the electric conductivity of these materials is approximately only 15% of the electric conductivity of copper. Therefore, generation of the creeping corona discharge in a dark place is delayed, which raises the switching electric discharge starting voltage FVs of the first electric discharge to be higher than that of the second electric discharge. Therefore, in the present invention, when the entire face of the electrode was plated with copper, the switching electric discharge starting voltage of FVs could be made close to the electric discharge starting voltage of Vs of the second discharge and after, and a further fluctuation of the electric discharge characteristic of the electrode among the manufacturing lots could be reduced. That is, the fluctuation of about 15% was reduced to the fluctuation of about 5%.

(2) In the present invention, the interval of the electric discharge gap was set to be always larger than the interval between the carbon trigger wire provided on the ceramic inner wall and the electric discharge electrode face which was located in the shortest distance from the carbon trigger wire. Due to the foregoing, it became possible to stabilize the FVS characteristic.

Embodiment

Next, an embodiment of the present invention will be explained referring to several comparative examples.

(1) Electrodes plated with copper and electrodes not plated with copper were used, and samples of the electric discharge tubes, which were respectively manufactured in the same manufacturing process, were left in a dark place for not less than 100 hours, and the switching electric discharge starting voltage FVs was measured in a dark place with respect to excellent electric discharge tubes. The results of the measurements are shown on Table 1.

In the electric discharge tubes (Comparative Examples 1 and 2) used for the above measurements, the electrodes shown in FIGS. 4(*a*) and 4(*b*) were used. The arrangement of the trigger wires is shown in FIG. 2(*a*). In Comparative Example 1, copper plating was not conducted, and in Comparative Example 2, copper plating was conducted. Investigations were made into changes in FVs and Vs when copper plating was conducted on the electrodes.

TABLE 1

| | Comparative Example 2 | | Comparative Example 1 | |
|---|---|---|---|---|
| | Start | Dark Place FVs | Start | Dark Place FVs |
| 1 | 800 | 824 | 812 | 912 |
| 2 | 804 | 832 | 818 | 872 |
| 3 | 810 | 846 | 802 | 882 |
| 4 | 804 | 848 | 786 | 834 |

TABLE 1-continued

| | Comparative Example 2 | | Comparative Example 1 | |
|---|---|---|---|---|
| | Start | Dark Place FVs | Start | Dark Place FVs |
| 5 | 814 | 818 | 796 | 844 |
| 6 | 818 | 836 | 794 | 854 |
| 7 | 806 | 852 | 820 | 840 |
| 8 | 798 | 876 | 772 | 900 |
| 9 | 790 | 798 | 856 | 896 |
| 10 | 792 | 816 | 812 | 904 |
| Maximum | 818 | 876 | 856 | 912 |
| Average | 803.6 | 834.6 | 806.8 | 873.8 |
| Minimum | 790 | 798 | 772 | 834 |
| 3 σ | 26.95 | 66.39 | 48.43 | 87.33 |

As can be seen on Table 1, the FVs characteristic of the electrode, which was plated with copper, could be suppressed to lower than the FVs characteristic of the electrode which was not plated with copper.

(2) Concerning the interval of the electric discharge gap and the shortest interval between the trigger wire provided on the ceramic inner wall and the electrode discharge electrode face, the measurement was made into a case in which the shortest interval between the trigger wire provided on the ceramic inner wall and the electrode discharge electrode face was larger than the interval of the electric discharge gap (Comparative Example 3), and also the measurement was made into a case in which the interval of the electric discharge gap was always larger than the shortest interval between the trigger wire provided on the ceramic inner wall and the electrode discharge electrode face (Comparative Example 4).

In the electric discharge tubes used for these measurements, the electrode shown in FIG. 4 was adopted for Comparative Example 3, and the electrode shown in FIG. 3 was adopted for Comparative Example 4. The arrangement of the trigger wires is shown in FIG. 2(*a*).

TABLE 2

| | Comparative Example 4 | | Comparative Example 3 | |
|---|---|---|---|---|
| | Start | Dark Place FVs | Start | Dark Place FVs |
| 1 | 794 | 816 | 784 | 862 |
| 2 | 812 | 828 | 812 | 884 |
| 3 | 794 | 822 | 814 | 828 |
| 4 | 818 | 828 | 818 | 856 |
| 5 | 780 | 800 | 784 | 824 |
| 6 | 816 | 832 | 768 | 816 |
| 7 | 792 | 828 | 818 | 860 |
| 8 | 800 | 840 | 824 | 884 |
| 9 | 786 | 814 | 816 | 848 |
| 10 | 826 | 836 | 792 | 836 |
| Maximum | 826 | 840 | 824 | 884 |
| Average | 801.8 | 824.4 | 803 | 849.8 |
| Minimum | 780 | 800 | 768 | 816 |
| 3 σ | 45.82 | 35.41 | 57.71 | 71.46 |

As can be seen on Table 2, when the interval of the electric discharge gap is always kept large, the FVs characteristic can be more stabilized and it becomes possible to provide a predetermined effect. These data were obtained as a result of the measurement in which the electric discharge tube was left in a dark place for not less than 100 hours and the switching electric discharge starting voltage FVs was measured in a dark place.

(3) Due to the foregoing, when the electric discharge tube is manufactured by combining the conditions of copper plating, item (1) in which the electrode is plated with copper and item (2) relating to the electric discharge gap with each other, it is possible to suppress and stabilize the FVs characteristic and exhibit the most excellent characteristic. The measurement results of an embodiment of the electric discharge tube, into which the above electrode was incorporated, are shown on Table 3. In this embodiment, the electrode shown in FIG. 3 was used, and the electric discharge tube, the surface of the electrode of which was plated with copper, was used. The trigger wires were arranged as shown in FIG. 2(*a*).

TABLE 3

| | Embodiment | |
|---|---|---|
| | Start | Dark Place FVs |
| 1 | 798 | 824 |
| 2 | 802 | 820 |
| 3 | 806 | 838 |
| 4 | 796 | 830 |
| 5 | 812 | 832 |
| 6 | 798 | 812 |
| 7 | 806 | 826 |
| 8 | 790 | 804 |
| 9 | 814 | 822 |
| 10 | 812 | 830 |
| Maximum | 814 | 838 |
| Average | 803.4 | 823.8 |
| Minimum | 790 | 804 |
| 3 σ | 23.84 | 29.99 |

(4) Next, investigations were made into the influence of the thickness of a copper plated layer.

As far as the initial characteristic is concerned, it is unnecessary to restrict the thickness of the copper plated layer. The reason is that the FVs characteristic is excellent when only the copper plated layer is provided. However, when the measurement relating to the dark place electric discharge characteristic was conducted, the most appropriate FVS was exhibited when the plate layer thickness was 10 μm to 20 μm. The reason is that the following measurement results were obtained.

The test conditions in the following tests (a) to (c) are described as follows.

Test Conditions

Ignitor: manufactured by Stanley Denki K. K.

Test cycle: operation for one second/stoppage for one second (about 100 Hz)

Test state: four sheathed insulating tubes

Interval of measurement: initial stage·50,000 times·100,000 times·150,000 times·200,000 times The electric discharge tube is left for not less than 24 hours and then measured for each measurement interval.

After the completion of the life test of 200,000 times, the electric discharge tube is left for 24 hours and further left for not less than 48 hours and then measured again.

Measuring apparatus: Tektronix TDS 544A oscilloscope/Tektronix P6015 voltage probe In this connection, in the measurements of the following items (a) to (c), the electric discharge tube shown in FIG. 1 was used, the electrode shown in FIG. 3 was adopted, and the arrangement of the carbon trigger wires on the ceramic cylindrical body shown in FIG. 2(*b*) was adopted.

(a) In the case where the copper plated layer thickness is smaller than 10 μm.

When the dark place electric discharge life characteristic test was executed, good results were obtained until the frequency of electric discharge reached 50,000 times. However, when the frequency of electric discharge exceeded 50,0000 times, the life characteristic became the same as that of the electrode not plated with copper. The reason why is thought to be as follows. Since the thickness of the copper plated layer was small, the thin copper plated layer on the electrode surface was immediately scattered by sputtering caused in the process of the life test, so that the base metal of the electrode was exposed. As a result, the copper plated electrode became the same as the conventional electrode which was not plated with copper. The results are shown on Tables 4 and 5.

TABLE 4

<Sample No. 1> Copper Plated Layer Thickness Is Smaller Than 10 μm

| | Start | 50000 | 100000 | 150000 | 200000 | Left over 48 Hours |
|---|---|---|---|---|---|---|
| FVs | 840 | 944 | 976 | 968 | 986 | 982 |
| Vs | 828 | 812 | 812 | 776 | 796 | 796 |

Unit: V (b) In the case where the copper plated layer thickness is not less than 20 μm. (The actual thickness is approximately 30 μm.)

Figure 6:
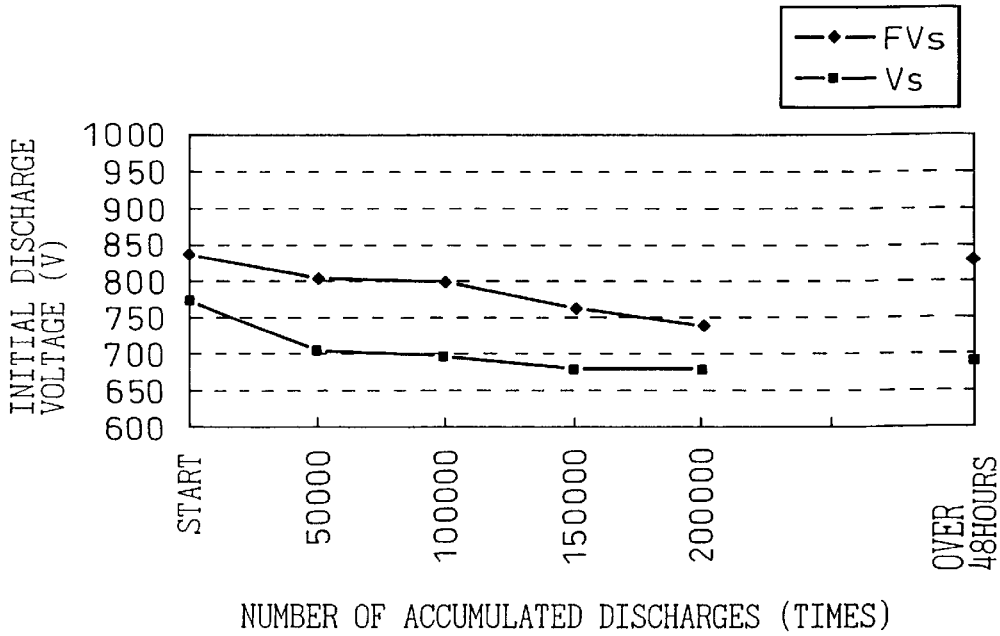
FIG. 6 is a graph showing the result of a dark place electric discharge life test which was made when the thickness of a copper plated layer was not less than 20 μm.

In the process of the electric discharge life test, the electric discharge starting voltages of both FVs and Vs were quickly lowered. This tendency is the same as that of the copper electrode, the material of which is non-oxygen copper. The reason is thought to be as follows. Since copper is a soft metal, it is easily scattered by sputtering in the process of electric discharge test. When the life test is continued, the electric discharge starting voltage is suddenly lowered and insulation is deteriorated by the sputter material which has been scattered onto the inner wall of the cylindrical body made of ceramic. This estimation was made from the fact that the color of the inner wall of the cylindrical body made of ceramic was turned to deep-black by the sputter material when the switching electric discharge tube was disassembled after the completion of the life test. The results are shown on Table 5 and FIG. 6.

TABLE 5

<Sample No. 2> Copper Plated Layer Thickness Is Smaller Than 20 μm

| | Start | 50000 | 100000 | 150000 | 200000 | Left over 48 Hours |
|---|---|---|---|---|---|---|
| FVs | 837 | 804 | 800 | 764 | 738 | 830 |
| Vs | 772 | 704 | 696 | 680 | 678 | 688 |

Unit: V (c) In the case where the copper plated layer thickness is 10 μm to 20 μm.

Figure 7:
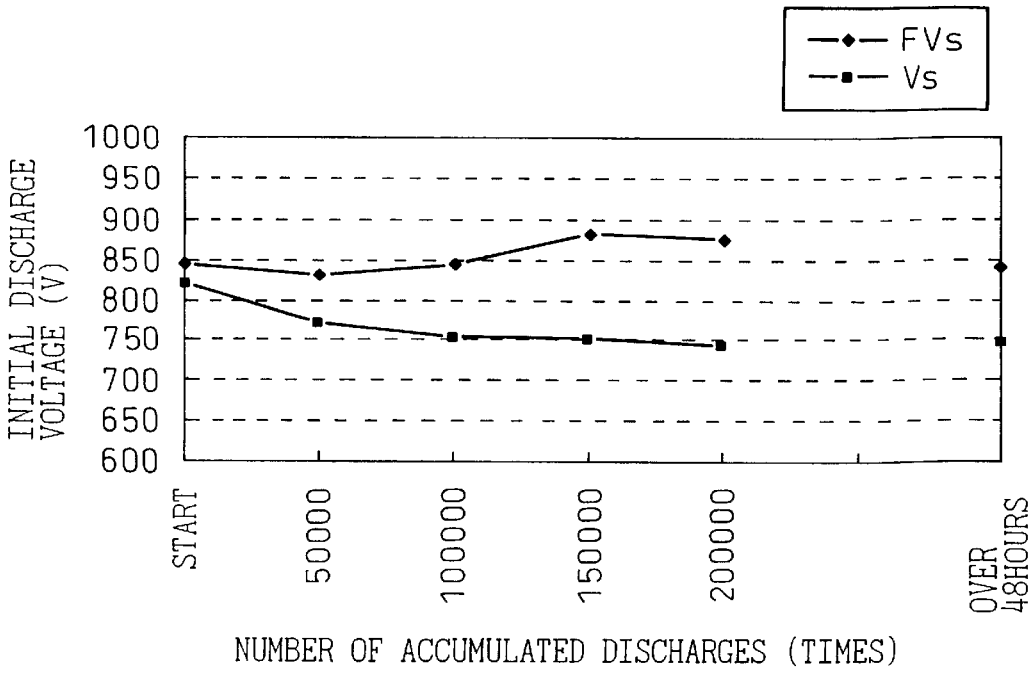
FIG. 7 is a graph showing the result of a dark place electric discharge life test which was made when the thickness of a copper plated layer was in a range from 10 to 20 μm.

In this case, the most excellent FVs characteristic is exhibited in the electric discharge life test. The results are shown on Table 6 and FIG. 7.

TABLE 6

<Sample No. 3> Copper Plated Layer Thickness Is 10 μm–20 μm

| | Start | 50000 | 100000 | 150000 | 200000 | Left over 48 Hours |
|---|---|---|---|---|---|---|
| FVs | 844 | 832 | 812 | 882 | 876 | 840 |
| Vs | 820 | 772 | 756 | 752 | 744 | 748 |

Unit: V

As explained above, according to the gas filled switching electric discharge tube of the present invention, (1) since the electrode surface is plated with copper, the FVs characteristic can be kept low and the obtained result is excellent. According to the present invention, when the electric discharge gap is set larger than the interval between the electric discharge face and the trigger wires provided on the inner wall of the cylindrical body, it becomes possible to facilitate the stabilization of the FVs characteristic in the case of electrically discharging in a dark place. The primary electric discharge is conducted in the electric discharge gap, however, the following operation is conducted until the electric discharge is started. (1) When an electric potential difference is generated between both end portions of the electrodes, an initial voltage is generated from the trigger wires and the filled gas is excited. (2) At the same time, the creeping corona discharge is generated on the electrode surface from the trigger wires to the primary electric discharge face (The primary electric discharge is generated on the electric discharge electrode face.). Therefore, the filled gas starts being excited together with the above item (1), and an electron avalanche is caused, so that the primary electric discharge is caused. As a result, when the interval of the electric discharge gap is always made larger than the shortest distance from the trigger wires on the inner wall of the cylindrical body to the electric discharge electrode, this FVs characteristic can be stabilized.

It should be understood be those skilled in the art that the foregoing description relates to only some preferred embodiments of the disclosed invention, and that various changes and modifications may be made to the invention without departing from the sprit and scope thereof.

What is claimed is:

1. A gas filled switching electric discharge tube comprising:

a cylindrical body made of insulating material;

a first electrode and a second electrode for airtightly closing both ends of the cylindrical body so that an electric discharge gap is formed between a first electrode face of the first electrode and a second electrode face of the second electrode, and an airtightly closed space formed in the cylindrical body being filled with gas;

metallized faces formed on both faces of the cylindrical body, the first electrode and the second electrode being joined to the cylindrical body on both the end faces of the cylindrical body;

first trigger wires formed on an inner wall face of the cylindrical body, connected with the metallized faces;

second trigger wires formed on the inner wall face of the cylindrical body, not connected with the metallized faces;

at least one of the first electrode face of the first electrode and the second electrode face of the second electrode is plated with copper or silver; and an interval of the electric discharge gap being made to be larger than a distance from the second trigger wires to the first electrode face or the second electrode face.

2. A gas filled switching electric discharge tube according to claim 1, wherein the cylindrical body is a cylinder, the first and the second electrode face are substantially circular and formed around the central axis of the cylindrical body, the first electrode face and the second electrode face are arranged being symmetrically opposed to each other, the first trigger wires extend from the metallized faces in the axial direction on the inner wall face of the cylindrical body but the first trigger wires do not reach a central portion of the cylindrical body, the second trigger wires extend in the central portion of the cylindrical body in the axial direction, and a distance (d) from the second trigger wires to the first electrode face or the second electrode face is a radial distance from an outer surface of these electrodes to an inner wall of the cylindrical body.

3. A gas filled switching electric discharge tube according to claim 2, wherein the electric discharge gap (t) is a distance between tips of the first electrode face and the second electrode face facing each other.

4. A gas filled switching electric discharge tube according to claim 2, wherein at least one of the first electrode face of the first electrode and the second electrode face of the second electrode is plated with copper or silver so that a thickness of the plated layer is 10–20 $\mu$m.

5. A gas filled switching electric discharge tube according to claim 1, wherein the number of the second trigger wires is larger than the number of the first trigger wires.

6. A gas filled switching electric discharge tube according to claim 5, wherein the first trigger wires extend from the metallized face in the axial direction along an inner wall face of the cylindrical body, however, do not extend over a central area, and, on the other hand, the second trigger wires extend in the axial direction at the central area.

7. A gas filled switching electric discharge tube according to claim 6, wherein the first trigger wires include a pair thereof spaced by 180°, one extending in the axial direction from one of the metallized faces and the other extending in the axial direction from the other of the metallized faces.

8. A gas filled switching electric discharge tube according to claim 7, wherein the pair of the first trigger wires are respectively composed of a plurality of trigger wires arranged close and parallel to each other.

9. A gas filled switching electric discharge tube according to claim 6, wherein the length of the first trigger wire in the axial direction is not more than ⅓ of the length of the cylindrical body in the axial direction.

10. A gas filled switching electric discharge tube according to claim 6, wherein a plurality of the second trigger wires are arranged at substantially regular intervals between a pair of the first trigger wires which are arranged at an interval of 180°.

11. A gas filled switching electric discharge tube according to claim 6, wherein the length of the second trigger wire in the axial direction is not less than ½ of the length of the cylindrical body in the axial direction.

12. A gas filled switching electric discharge tube according to claim 1, wherein a plurality of recess portions are provided on at least one of the first and the second electrode faces.

13. A gas filled switching electric discharge tube according to claim 12, wherein the recess portions are respectively hemispherical recess portions.

14. A gas filled switching electric discharge tube according to claim 13, wherein the plurality of recess portions are uniformly arranged at regular pitches of 0.1 mm–1.0 mm.

15. A gas filled switching electric discharge tube according to claim 1, wherein the first and the second electrode face are arranged symmetrically opposed to each other, central portions of the electrode faces are hollowed with respect to the peripheral portion, and the plurality of recess portions are formed in the hollow portion.

16. A gas filled switching electric discharge tube according to claim 1, wherein the cylindrical body is made of ceramic, and the first electrode and the second electrode are made of iron-nickel alloy such as 42 alloy or an iron-nickel-cobalt alloy such as covar.

17. A gas filled switching electric discharge tube according to claim 1, wherein the first electrode and the second electrode are joined to the cylindrical body by means of soldering.

* * * * *